United States Patent [19]

Andersson

[11] 3,949,688

[45] Apr. 13, 1976

[54] APPARATUS FOR AUTOMATICALLY MANUFACTURING AN ANNULAR RIBBON

[76] Inventor: Sven Gerhard Andersson, Ljungskile, Sweden

[22] Filed: Jan. 20, 1972

[21] Appl. No.: 219,581

Related U.S. Application Data

[63] Continuation of Ser. No. 864,311, Oct. 7, 1969, abandoned.

[30] Foreign Application Priority Data

Oct. 7, 1968 United Kingdom ..... 47451/68

[52] U.S. Cl. ..... 112/121.26; 112/121.27

[51] Int. Cl.[2] ..... D05B 35/00

[58] Field of Search..... 112/121.26, 121.15, 121.11, 112/203, 130, 121.27

[56] References Cited

UNITED STATES PATENTS

| | | | |
|---|---|---|---|
| 3,375,796 | 4/1968 | Greenberg et al. | 112/121.15 |
| 3,426,708 | 2/1969 | Andersson | 112/121.26 |
| 3,443,533 | 5/1969 | Posey et al. | 112/121.11 |

*Primary Examiner*—Werner H. Schroeder
*Attorney, Agent, or Firm*—Pollock, Vande Sande & Priddy

[57] ABSTRACT

Apparatus for automatically manufacturing an annular ribbon from stock as, for example, from a reel or roll of such ribbon. A feeding device cuts a length of ribbon dependent upon the preselected size of the annular ribbon, and the apparatus includes a pair of grip members which selectively hold the ends of the ribbon both during the formation of the loop and while the ribbon is being cut from the stock. The grip member rotates so as to cause the two free ends of the ribbon to overlap, thereby permitting the free ends to be secured together as by sewing.

2 Claims, 5 Drawing Figures

Inventor
Sven G. Andersson
by Sommers & Young
Attorneys

Inventor
Sven G. Andersson
by Sommers & Young
Attorneys

Inventor
Sven G. Andersson
by Sommers & Young
Attorneys

Inventor
Sven G. Andersson
by Sommers & Young
Attorneys

APPARATUS FOR AUTOMATICALLY MANUFACTURING AN ANNULAR RIBBON

This application is a continuation of application Ser. No. 864,311, filed Oct. 7, 1969, and now abandoned.

This invention relates to an arrangement or apparatus for automatically manufacturing an annular ribbon, preferably an elastic ribbon, wherein the ribbon is advanced from stock, for example from a roll.

According to the invention there is provided an apparatus for the automatic manufacture of an annular ribbon, preferably an elastic ribbon, wherein the ribbon is advanced from stock, for example from a roll, characterized in that the apparatus comprises a feeding device for feeding a length determined for the size of the annular ribbon, a cutting device for cutting off the ribbon when a length fitted to the annular size has been advanced, grip members for gripping positively prior to the cutting of the advanced ribbon at its free end and at the other free end obtained after the cutting, said grip members being turnable for the overlapping of the free ends of the ribbon being cut, guide means for guiding said grip members with the ribbon ends overlapping each other to an arrangement for joining the said overlapping ribbon ends, and drive means for positively operating in a certain time sequence the feeding device, the grip members, the cutting device and the guide means.

The apparatus adjusts automatically the ribbons which are required for an elastic ring of a certain size, unites the ribbon to a ring and thereafter introduces the ring into a sewing machine for being sewn together, or into another joining arrangement.

Figure 1:
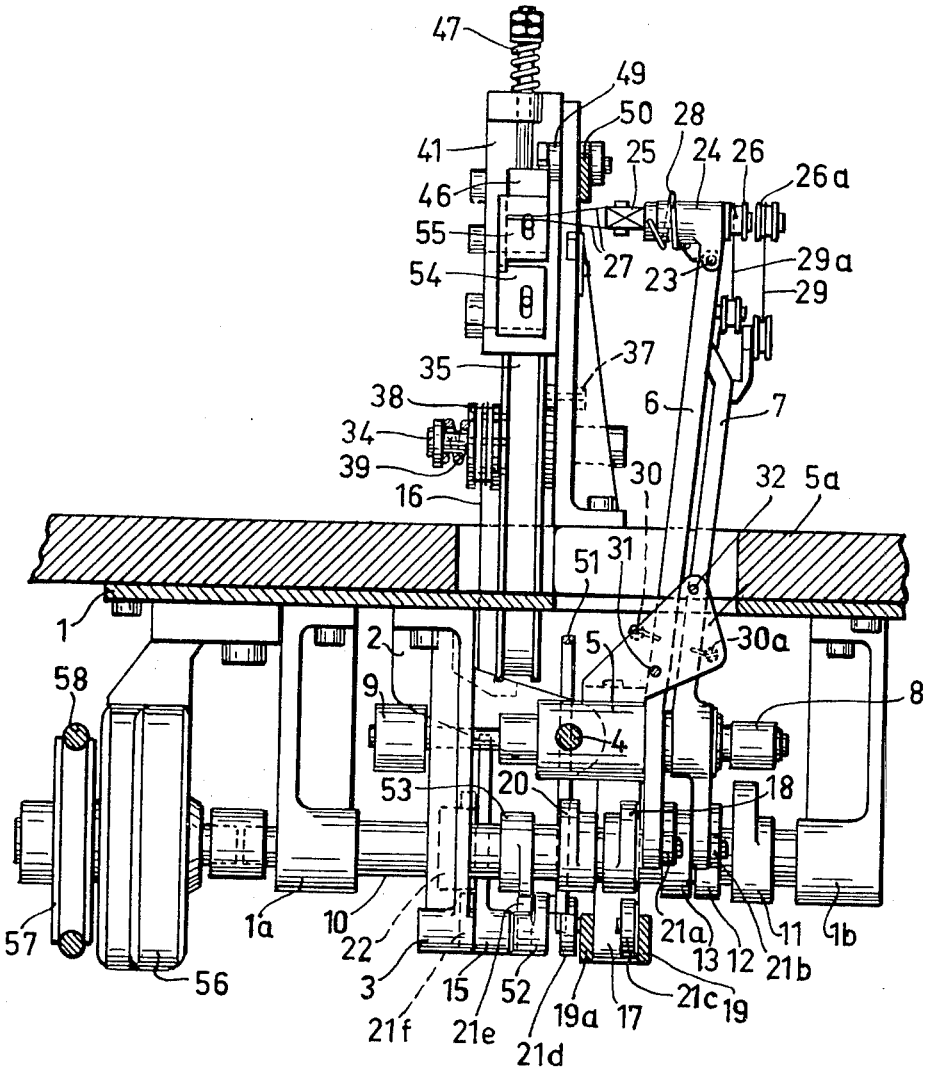
Figure 2:
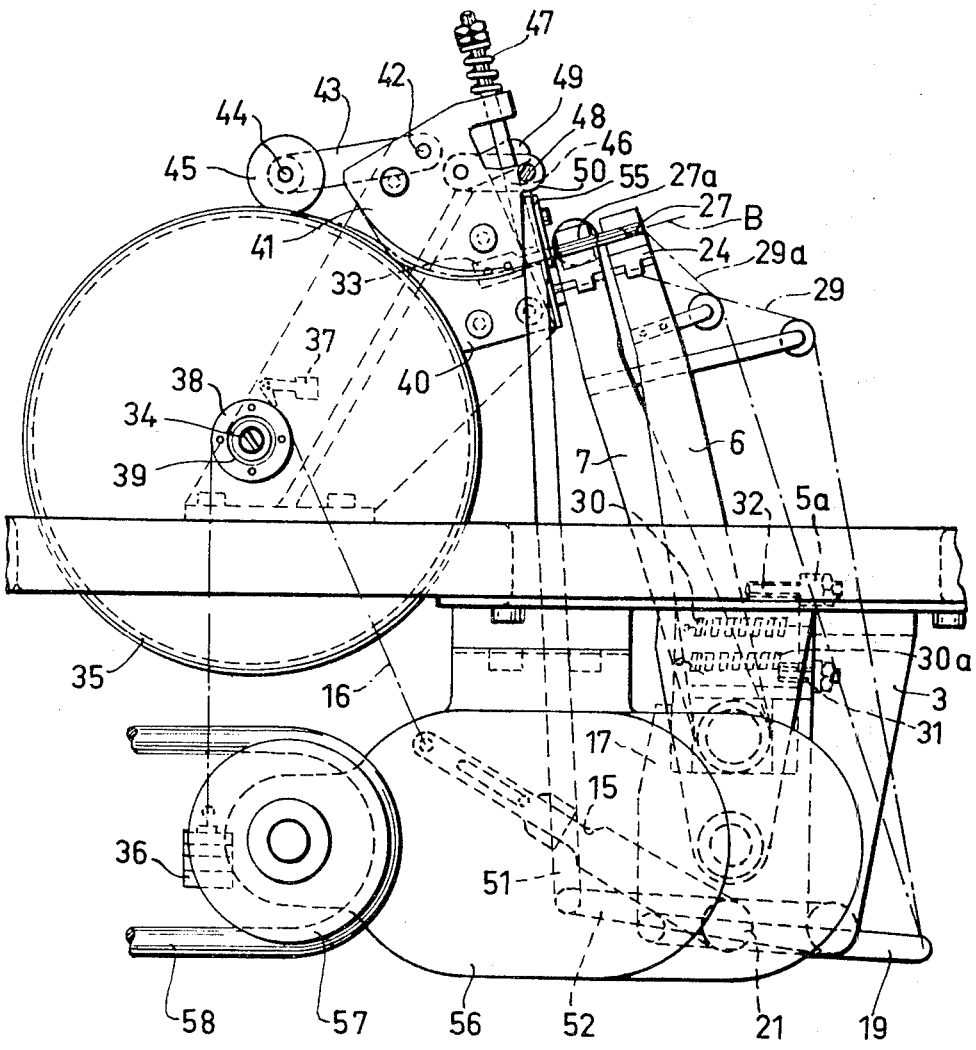
Figure 3:
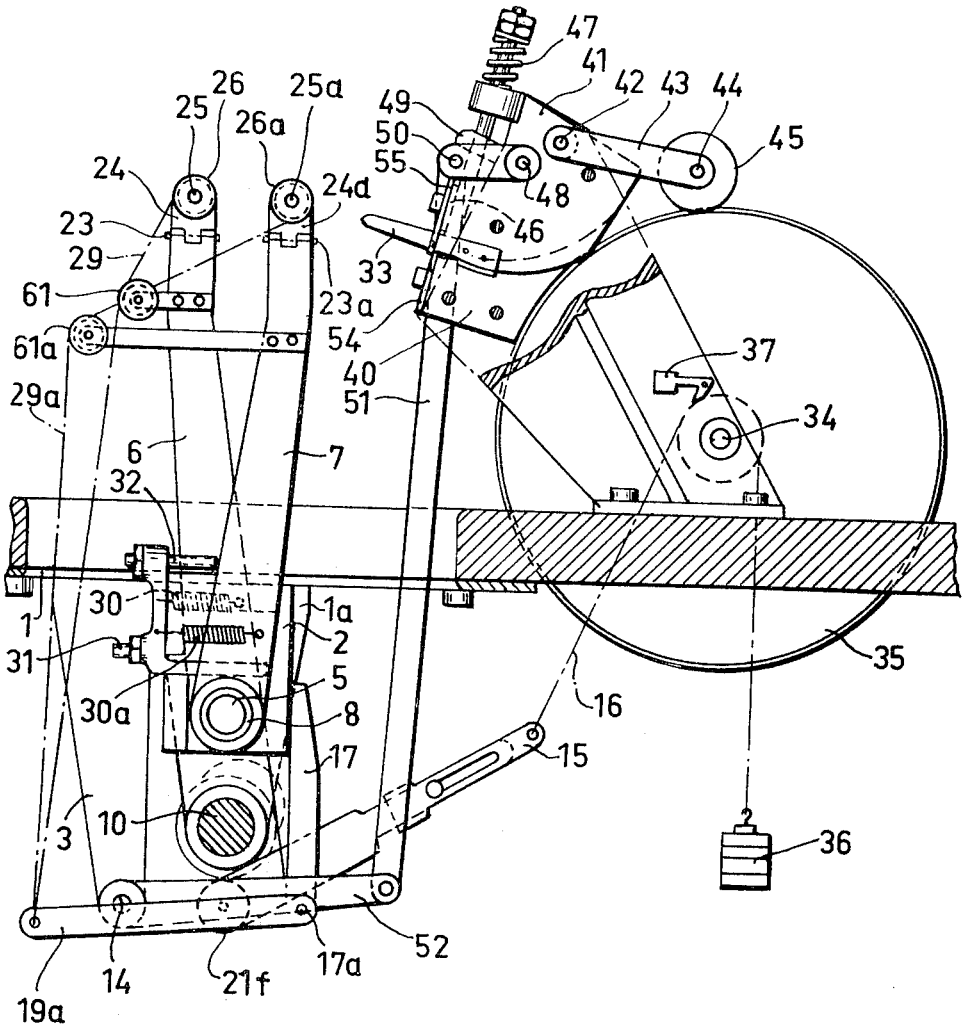
Figure 4:
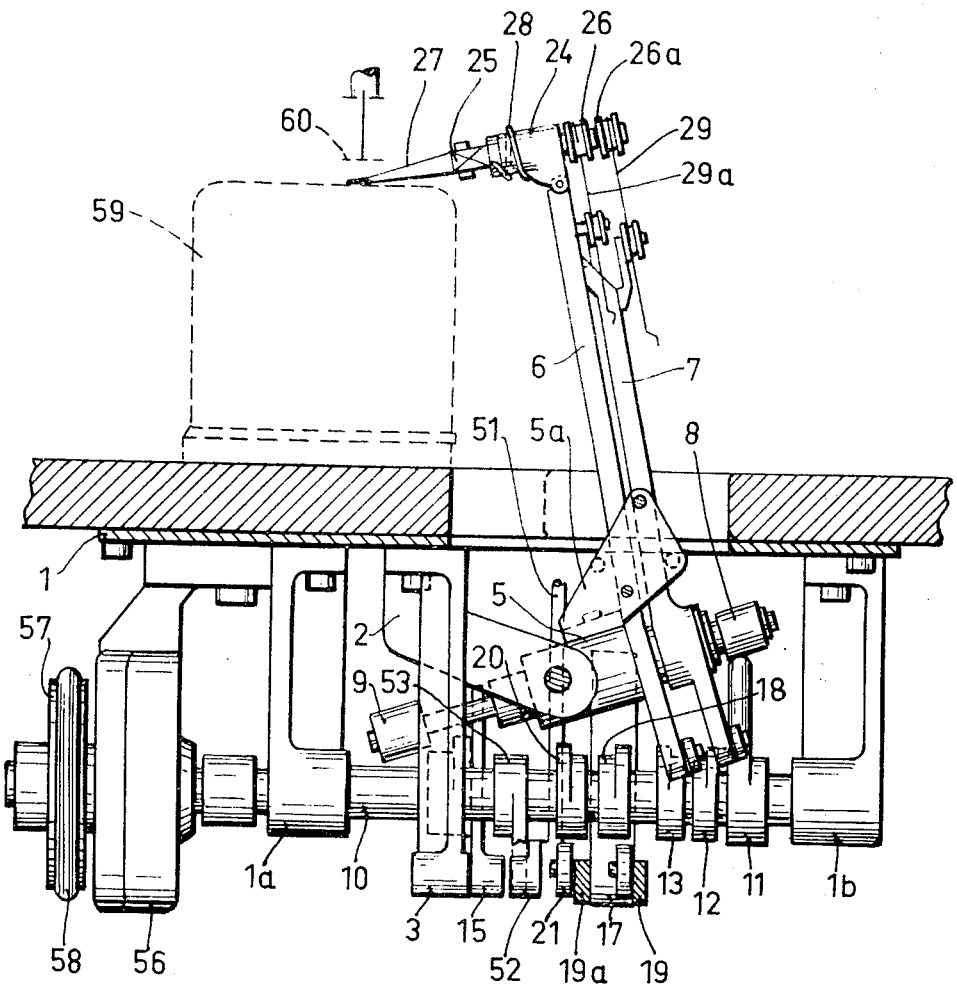
Figure 5:
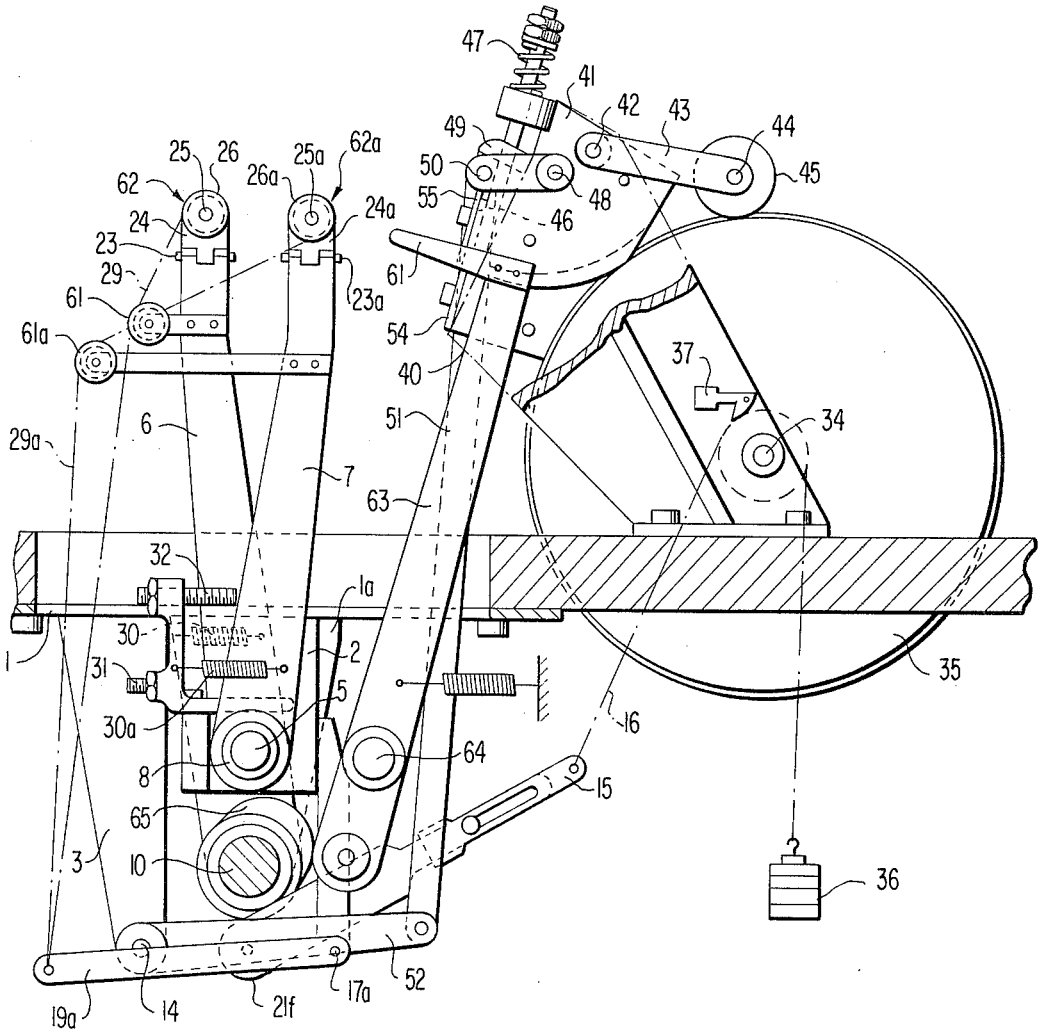

An embodiment of the invention will now be described by way of example, and with reference to the accompanying drawings, in which:

FIG. 1 shows a lateral view of an apparatus according to the invention,

FIG. 2 shows a view seen from the left-hand side in FIG. 1 and intended to show a starting position for the apparatus before the ribbon is fed into the same, FIG. 3 shows a view seen from the right-hand side in FIG. 1 and primarily intends to show the guide means for the feeding device, cutting device and grip members comprised in the apparatus, certain parts, however, being omitted for better clarity, FIG. 4 shows in a view corresponding to FIG. 1 the apparatus connected to a sewing machine, also here certain parts being omitted, and FIG. 5 illustrates an alternative embodiment of the invention in which the grip members are stationary and the locking element is movable.

As appears from FIG. 4, the apparatus shown is arranged in the embodiment at a sewing machine which is indicated by dashed lines in FIG. 4 and has the reference numeral 59, the press foot having the reference numeral 60.

The apparatus comprises a plate 1 secured by screwing to the lower surface of the sewing machine table. On the plate 1 are secured two bearing supports 1*a* and 1*b* for a drive shaft 10, together with an angular support 2 and an arm 3. The angular support 2 carries an axle journal 4 about which is pivoted a two-armed shaft 5 which at one free end carries a weight 9 and at its other free end is provided with a cam roll 8. Between the cam roll 8 and the axle journal 4 two rocker arms 6 and 7 are rockingly mounted on the shaft 5. The rocking arms support at their lower free ends cam rolls 21*a* and 21*b* respectively and are at their upper ends provided with tweezers-like grip members 27 and 27*a* respectively for the ribbon. On the drive shaft 10 which is driven from the sewing machine motor via a belt 58, a pulley 57 and a gear 56, cams 11, 12 and 13 are mounted for cooperation with the cam rolls 8, 21*b* and 21*a* respectively. For a reason explained below the drive shaft 10 is provided also with additional cams 18, 20, 22 and 53.

At the free end of the arm 3 is mounted an axis journal 14 about which is pivotable an angular arm 15 which can be adjusted in the longitudinal direction. At the free end of the angular arm 15 is mounted a steel rope 16 wound a desired number of turns about a rope wheel 38 and carrying at its free end a weight 36. At the arm 15 is mounted a cam roll 21*f* for cooperation with the cam 22 on the drive shaft 10. On the axle journal 14 further is mounted an arm 52 which via a link is connected with an arm 51 having the function described below in a greater detail. At the arm 52 is mounted a cam roll 21*e* for cooperation with the cam 53 on the drive shaft 10.

An arm 17 is secured at the angular support 2 and at its free end provided with a shaft 17*a* on which are mounted two arms 19 and 19*a*. At said arms 19, 19*a* are arranged two cam rolls 21*c* and 21*d* respectively for cooperation with the cams 18 and 20 respectively on the drive shaft 10.

The aforesaid tweezers-like grip members 27 and 27*a* are secured in axle journals 25 and 25*a* respectively which in their turn are pivoted in sleeves 24 and 24*a* respectively and hereby actuated by springs 28 and 28*a* respectively. The said sleeves are articulated on the rocking arms 6 and 7 respectively by shafts 23 and 23*a* respectively. On that side of the sleeves 24 and 24*a* which is located opposite to the grip members 27 and 27*a* respectively, pulleys 26 and 26*a* respectively are mounted on the shafts 25 and 25*a* respectively. Drive members such as cords 29 and 29*a* respectively are secured at one end of the pulleys 26 and 26*a* respectively, drawn over guide disks 61 and 61*a* carried by the arms 6 and 7 respectively and at their other end secured at the arms 19 and 19*a* respectively.

On the upper surface of the sewing machine table is secured by screwing a support carrying a shaft 34 on which is mounted a feed wheel 35 for the ribbon. The shaft 34 further is provided with the wheel 38 for the cord 16 and a spring 39 which presses pawls on the wheel 38 against teeth in the feed wheel 35. A pawl 37 is mounted for locking the feed wheel 35 in advanced position. The said support also carries a device for opening the tweezers blades and a device for cutting the ribbon.

The device for opening the tweezers blades, so that a ribbon can be inserted between the same, comprises a wedge-shaped arm 33 mounted on the support, which arm upon the swinging of the rocking arms against the same penetrates between the blades and presses them apart. Upon the swing-back motion of the rocking arms and when the arm 33 is disengaged from the tweezers blades, said blades again are pressed against each other and against a ribbon inserted between the blades.

The device for cutting the ribbon comprises a knife mounting 40 secured on the support, at which mounting is attached adjustable a knife 54. On said knife mounting 40 is fastened a holder 41 and a guide 46 provided with an adjustable knife 55 mounted in said holder. The device also comprises a rod mounted at the guide and a spring 47 about said rod. The spring 47 normally maintains the guide 46 with its knife 55 spaced from the knife 54. On the support is further mounted a shaft 48, to which is secured an arm 49 which with its free end abuts to the guide 46. An arm 50 which also is mounted at the shaft 48 is articulated with the aforesaid arm 51.

On the support on the upper surface of the sewing machine table there is further mounted a shaft 42 to which is secured an arm 43 which at its free end is provided with a shaft 44 for a pressure roll 45. The said roll presses the ribbon against the feed wheel 35 for preventing the ribbon from sliding, especially at its start. The ribbon can be fed to the feed wheel 35 from rolls or from ribbon collected in another way.

The apparatus finally comprises set screws 31 and 32 for adjusting the rocking arms 6 and 7 respectively, so that the grip members 27 and 27*a* respectively are given their correct position in relation to the sewing machine needle. The set screw 31 is mounted on a spring holder 5*a* which is secured at the two-armed shaft 5. The set screw 32 is also mounted on the spring holder 5*a*. Also on the spring holder 5*a* is attached one end of each tension spring 30 and 30*a* respectively for the rocking arms 6 and 7 respectively, the other ends of said springs being fastened to the rocking arms.

The apparatus operates as follows:

Upon starting the sewing machine motor, the drive shaft 10 rotates by the transfer of motion via the belt 58, the pulley 57 and the gear 56 which is stepped down and in direct connection with the drive shaft 10. The shaft 10 rotates one revolution for every ribbon completely sewn. From the shaft 10 are effected and controlled all functional movements of the apparatus by the aforementioned cams, cam rolls, arms and cords illustrated on the drawings. The cams are arranged such that a pre-determined time sequence between the various functions is obtained. The cams may also be exchangeable so as to vary the period length for the various functions. This applies particularly to the cams 22 for varying the ribbon length advanced.

The starting position of the apparatus is shown in FIG. 2. The tweezers blades 27 and 27*a* are open, i.e. the wedge-shaped arm 33 is placed between the blades. This position was obtained by the rocking arms 6 and 7 respectively which were positively turned against the action of the springs 30 and 30*a* respectively by the cam rolls 21*a* and 21*b* respectively and the cams 13 and 12 respectively.

The cams 18 and 20 are in engagement with the cam rolls 21*c* and 21*d* whereby the shafts 25 and 25*a* respectively are rotated against the action of the springs 28 and 28*a* respectively into the position shown in FIG. 2 by the downward swinging motion of the arms 19 and 19*a* respectively and, whereby, by the downward pulling of the cords 29 and 29*a* respectively. The cam 53, furthermore, is out of engagement with the cam roll 21*e* so that the arm 49 is lifted up into its upper end position and the knives 54 and 55 are separated. The cam 22, finally, is out of engagement with the cam roll 21*f*, and the arm 15 is in its uppermost end position.

Upon rotation of the drive shaft 10, the cam 22 presses the arm 15 downwards whereby the rope 16 rotates the rope wheel 35 for the ribbon B. After a certain ribbon length was fed between the open tweezers blades, for example 20 mm beyond the grip member 27, the cam 13 leaves the engagement with the cam roll 21*a* whereby the rocking arm 6 with the grip member 27 is turned to the right in FIG. 2. The grip member 27 hereby disengages the wedge-shaped arm 33, and the ribbon is caught by the tweezers blades. During the turning motion of the arm 6 into abutment with the set screw 31 the cam 18 leaves the engagement with the cam roll 21*c* whereby the shaft 25 and thereby the grip member 27 are rotated half a revolution by the spring 28, so that the ribbon end is directed substantially opposite to the direction of the ribbon advanced through the grip members.

By the continued feed of the ribbon now is formed a loop suspended between the grip member 27 and the grip member 27*a*, which latter still is in the starting position. When the ribbon length located between the grip members approaches the pre-determined length, the arm 7 by cooperation between the cam 12 and the cam roll 21*b* and by the action of the tension spring 30*a* is turned to a position from the knives 54 and 55 which suitably agrees with the length for the free ribbon end projecting out of the grip member 27. When the ribbon length determined by the cam 22 and by the finely adjustable arm 15 has been fed, the cam 53 engages with the cam roll 21*e* so that the knife 55 is pressed downwards and cuts off the ribbon, at the same time as the arm 7 is turned additionally by cooperation of the eccentric 12 so that the grip member 27*a* disengages the wedge-shaped arm 33 and the ribbon is caught by the tweezers blades whereafter the cam roll 21*e* disengages the cam 53, and the knives are separated. Upon the continued turning motion of the arm 7 to the set screw 32 by the tension spring 30*a* and while the eccentric 12 leaves the engagement with the cam roll 21*b*, the cam 20 leaves the engagement with the cam roll 21*d* whereby the shaft 25*a* and thereby the grip member 27*a* are rotated half a revolution by the spring 28*a*, so that the free ribbon ends projecting out of the grip members 27 and 27*a* are overlapping one another. Hereby the ribbon forms an unjoined ring.

It is to be observed that the ribbon B is fed with a lower speed at the beginning and at the end, in order to enable the rocking arms 6 and 7 to carry out their turning motions for bringing the grip members 27 and 27*a* into engagement with the ribbon.

All of the cam rolls 20*a–f* are now out of engagement with the respective cams 12, 13, 18, 20, 53 and 22. Upon the continued rotation of the drive shaft 10 the cam 11 strikes against the cam roll 8 and swings the shaft 5 about the journal 4 and thereby the rocking arms 6 and 7 by means of the ribbon ring held together by the grip members 27 and 27*a* to the position shown in FIG. 4, i.e. the overlapping ribbon ends are located below the press foot 60 of the sewing machine. When the tweezers blades of the grip members meet the sewing machine table, they can follow the table because the sleeves 24 and 24*a* respectively are linked at the rocking arms 6 and 7 respectively by the shafts 23 and 23*a* respectively. The cam 11 is preferably exchangeable for being adapted to vary the size of the swinging motion of the shaft 5 to adjust to different ribbon widths. When the ribbon is in correct position below the press foot 60, a micro-switch (not shown) sends an impulse to magnetic lifter (not shown) connected to the starting arm of the sewing machine, and the press foot falls down to lock the ribbon. Thereafter, by rolling the cam roll 8 off the cam 11, the grip members are pulled out of engagement with the locked ribbon. The sewing machine starts and joins the overlapping ribbon ends whereafter, finally, in a suitable way by means of a mechanism provided on the sewing machine the ribbon ring after its joining is pushed out an collected.

As an example may be mentioned that, depending on the capacity of the sewing machine, 20 to 25 ribbons can be produced per minute.

An improvement of the above-described apparatus has been developed which provides several important advantages. The improved apparatus is shown in FIG. 5. Thus an apparatus has been constructed in which a movable locking element 61 is arranged instead of the stationary locking element 33 in the embodiment shown. The movable locking element 61 is advanced between the two grip members and presses the grip members 62 and 62*a* apart, whereafter the ribbon is advanced between the grip members. The element 61 is advanced by an arm 63 pivoted at 64 and actuated by cam 65 on shaft 10. The two grip members 62 and 62*a* are rendered stationary by causing their respective actuating cams 13 and 12, respectively, to have a circular instead of an eccentric contour. After a predetermined loop of the ribbon between the grip members has been formed as previously described, the locking element 61 has been moved out of engagement with the grip members 62 and 62*a* and the latter then both grip the ribbon. The movement of the locking element is synchronized with the advance of the ribbon. After the ribbon has been gripped by the grip members, the cutting takes place by means of knives 54 and 55, whereafter the grip members are turned in order to get the overlapping of the free ends of the ribbon. Except for this turning movement the grip members are held stationary during the above mentioned operations.

This latter construction provides several advantages over the earlier-described apparatus and thus provides similar advantages over what is disclosed and claimed in my prior U.S. Pat. No. 3,426,708. Thus, the latter construction provides a more reliable machine. Also, the machine has fewer moving parts to wear and malfunction.

Furthermore, instead of the drive means in the embodiment shown comprising the common drive shaft and the mechanical transmissions means, any conventional drive system can be employed in the embodiment shown as well as in the above described embodiment, such as an hydraulic or pneumatic drive system.

What I claim is:

1. Apparatus for the automatic manufacture of an annular ribbon of predetermined size from a continuous stock of such ribbon comprising in combination, a pair of ribbon grip members being rotatable but fixed in translation, grip actuating means for selectively opening and closing said grip members, means for feeding the free end of the ribbon from the reel while said grip opening means holds both said grip members open, loop forming means effective when said grip actuating means holds open only the one said grip member which governs the feed of ribbon from the stock to feed said ribbon through said one grip member so as to form a loop therein of preselected size, means for cutting the ribbon between said one grip member and the reel after the formation of the loop in said ribbon, means for moving the grip actuating means out of engagement with first one and then the other of the grip members to thereby catch the free end of the ribbon and then the free end obtained after cutting, means for rotating both said grip members to thereby overlap the two free ends of the ribbon, and means for joining the two free ends of the ribbon to form a closed loop.

2. Apparatus according to claim 1 which additionally includes a loop-forming member for forming a predetermined loop of the ribbon between the grip members.

* * * * *